US006846529B2

(12) United States Patent
Mohan et al.

(10) Patent No.: US 6,846,529 B2
(45) Date of Patent: Jan. 25, 2005

(54) LOW DENSITY PAPERBOARD ARTICLES

(75) Inventors: Kosaraju Krishna Mohan, Texarkana, TX (US); Alexander A. Koukoulas, Ridgewood, NJ (US); Peter Matthew Froass, Chester, NY (US); David Verd Reed, Blanchester, OH (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 10/666,416

(22) Filed: Sep. 19, 2003

(65) Prior Publication Data

US 2004/0052989 A1 Mar. 18, 2004

Related U.S. Application Data

(62) Division of application No. 09/770,340, filed on Jan. 26, 2001.
(60) Provisional application No. 60/178,214, filed on Jan. 26, 2000.

(51) Int. Cl.[7] ..... B27N 5/02; B32B 23/08; B32B 5/20; B32B 1/02; B65D 81/38

(52) U.S. Cl. ..... 428/34.2; 428/141; 428/153; 428/327; 428/513; 428/537.5; 220/592.17; 220/592.16; 220/62.12; 220/62.2; 220/62.22; 220/677; 220/592.2; 229/103.11; 162/134; 162/164.1

(58) Field of Search ..... 428/34.2, 141, 428/153, 327, 513, 537.5; 220/592.17, 592.2, 592.16, 62.12, 62.7, 62.22, 677, 62.2; 229/103.11; 162/134, 164.1

(56) References Cited

U.S. PATENT DOCUMENTS 3,293,114 A 12/1966 Kenaga et al.
3,357,322 A 12/1967 Gill
3,468,467 A 9/1969 Amberg
3,556,934 A 1/1971 Meyer
3,615,972 A 10/1971 Morehouse et al.
3,779,951 A 12/1973 Streu
3,785,254 A 1/1974 Mann
3,819,470 A 6/1974 Shaw et al.
3,941,634 A 3/1976 Nisser et al.

(List continued on next page.)

FOREIGN PATENT DOCUMENTS

JP 2669767 10/1997

OTHER PUBLICATIONS

Tappi/ May 1972, vol. 55, No. 5, p. 770–771.
Tappi/ Dec. 1973, vol. 56, No. 12, p. 158–160.
"The Use of Microspheres to Improve Paper Properties", by Soderberg, Paper Technology, Aug. 1989, pp. VIII/17–VII/21.
"Xpancel®", An Introduction, a publication from Expancel, Box 13000, S0–850 13 Sundsvall, Sweden.

(List continued on next page.)

*Primary Examiner*—Harold Pyon
*Assistant Examiner*—Chris Bruenjes
(74) *Attorney, Agent, or Firm*—Luedeka, Neely & Graham, PC

(57) ABSTRACT

The invention provides a low density paperboard material for use in producing an insulated container, and is especially well-suited for making cups. The paperboard material comprises a paperboard web including wood fibers and expanded microspheres, and has a relatively low density ranging from about 6 to about 10 lb/3MSF/mil, a relatively high caliper ranging from about 24 to about 35 mil, and an internal bond strength of at least about $80\times10^{-3}$ ft-$lb_f$ preferably at least $100\times10^{-3}$ ft-$lb_f$. For applications such as cups the material is also coated on one or both sides with a barrier coating, preferably low density polyethylene, to limit liquid penetration into the web. The low density paperboard material of the invention is convertible for manufacture of containers, particularly cups, and the surface of the low density board may have a Sheffield smoothness of 300 SU or greater.

2 Claims, 3 Drawing Sheets

U.S. PATENT DOCUMENTS

| | | | | |
|---|---|---|---|---|
| 4,051,277 | A | | 9/1977 | Wilkinson |
| 4,133,688 | A | | 1/1979 | Sack |
| 4,179,546 | A | | 12/1979 | Garner et al. |
| 4,233,325 | A | | 11/1980 | Slangan |
| 4,237,171 | A | | 12/1980 | Laage |
| 4,241,125 | A | | 12/1980 | Canning |
| 4,324,753 | A | | 4/1982 | Gill |
| 4,435,344 | A | | 3/1984 | Iioka |
| 4,451,585 | A | | 5/1984 | Andersson |
| 4,483,889 | A | | 11/1984 | Andersson |
| 4,548,349 | A | | 10/1985 | Tunberg |
| 4,581,285 | A | | 4/1986 | Mahefkey, Jr. |
| 4,617,223 | A | | 10/1986 | Hiscock |
| 4,619,734 | A | | 10/1986 | Andersson |
| 4,777,930 | A | | 10/1988 | Hartz |
| 4,781,243 | A | | 11/1988 | DeVogel |
| 4,836,400 | A | | 6/1989 | Chaffey et al. |
| 4,898,752 | A | | 2/1990 | Cavagna |
| 4,902,722 | A | | 2/1990 | Melber |
| 4,946,737 | A | | 8/1990 | Lindeman et al. |
| 4,982,722 | A | | 1/1991 | Wyatt |
| 4,988,478 | A | | 1/1991 | Held |
| 5,092,485 | A | | 3/1992 | Lee |
| 5,096,650 | A | | 3/1992 | Renna |
| 5,125,996 | A | | 6/1992 | Campbell et al. |
| 5,145,107 | A | | 9/1992 | Silver |
| 5,226,585 | A | | 7/1993 | Varano |
| 5,363,982 | A | | 11/1994 | Sadlier |
| 5,370,814 | A | | 12/1994 | Salyer |
| 5,424,519 | A | | 6/1995 | Salee |
| 5,454,471 | A | | 10/1995 | Norvell |
| 5,477,917 | A | | 12/1995 | Salyer |
| 5,478,988 | A | | 12/1995 | Hughes et al. |
| 5,490,631 | A | | 2/1996 | Iioka |
| 5,499,460 | A | | 3/1996 | Bryant |
| 5,514,429 | A | * | 5/1996 | Kamihgaraguchi et al. ..... 428/34.2 |
| 5,520,103 | A | | 5/1996 | Zielinski et al. |
| 5,601,744 | A | | 2/1997 | Baldwin |
| 5,637,389 | A | | 6/1997 | Colvin et al. |
| 5,705,242 | A | | 1/1998 | Andersen |
| 5,759,624 | A | | 6/1998 | Neale et al. |
| 5,792,398 | A | | 8/1998 | Andersson |
| 5,800,676 | A | | 9/1998 | Koike et al. |
| 5,880,435 | A | | 3/1999 | Bostic |
| 5,884,006 | A | | 3/1999 | Frohlich et al. |
| 5,952,068 | A | | 9/1999 | Neale et al. |
| 6,133,170 | A | * | 10/2000 | Suenaga et al. ..... 442/334 |
| 6,379,497 | B1 | | 4/2002 | Sandstrom et al. |
| 6,391,943 | B2 | * | 5/2002 | Sarma et al. ..... 523/160 |

OTHER PUBLICATIONS

"The Application of Microspheres for the Production of High Bulk Papers", by M. Baumeister, Das Papier, vol. 26, No. 10A: 716–720 (1972).

"Microspheres find use as fiber replacement in low–density board", by David O. Bowen, Pulp & Paper Nov. 1976, p. 126–127.

Expancel ® Expandable Microspheres in Paper and Board, by Mark Lunabba, KemaNord Plast AB, Sector Microspheres, Box 13000, S–850 13 Sundsvall, Sweden.

"Expandable Microspheres in Board", World Pulp & Paper Technology, pp. 143–145.

"Foams on the Cutting Edge", by Ray Erikson, Jan. 1999.

* cited by examiner

LOW DENSITY PAPERBOARD ARTICLES

This application is a division of copending application Ser. No. 09/770,340 filed Jan. 26, 2001, which is in turn claims the benefit of the earlier filing date of provisional application Ser. No. 60/178,214, filed Jan. 26, 2000.

FIELD OF THE INVENTION

This invention relates generally to the production of articles from low density paper and paperboard and to insulated articles made therefrom, and in particular, relates to cups made of low density paper and paperboard.

BACKGROUND AND SUMMARY OF THE INVENTION

Insulated cups and containers are widely used for serving hot and cold beverages and other food items. Such articles may be made from a variety of materials including polystyrene foam, double-walled containers, and multi-layered paper-based containers such as paperboard containers containing an outer foamed layer. Paper-based containers are often more desirable than containers made from styrene-based materials because paper-based materials are generally more amenable to recycling, are biodegradable and have a surface more acceptable to printing. However, multi-layered and multi-walled paper-based containers are relatively expensive to manufacture compared to polystyrene foam-based articles and often do not exhibit comparable insulative properties. Paperboard containers having an outer foam insulation layer are generally less expensive to produce than double-walled containers, but the outer surface is less compatible with printing.

Attempts have been made to improve certain properties of paper by incorporating expanded as well as unexpanded microspheres within the paper. For example, U.S. Pat. No. 3,556,934 to Meyer describes production of paper products for books, magazines, and the like wherein unexpanded microspheres are incorporated into a papermaking furnish which is then formed into a web and dried. The microspheres expand on drying to produce a sheet said to have improved stiffness and caliper. However, the '934 patent deals with relatively low basis weight paper not suitable for insulated container manufacture, makes no mention of use of the product in the manufacture of paperboard containers having insulative properties, and gives no teaching as to how such a product could be produced so as to enable use of the product in fabricating insulative containers such as cups and the like.

Accordingly, there continues to be a need for paper-based materials which have good insulative properties and which can be produced on a competitive basis with polystyrene foam-based articles.

SUMMARY OF THE INVENTION

The present invention is directed to a low density paperboard material for use in producing insulated containers such as paper cups. In general, the paperboard material comprises a paperboard web that includes expanded microspheres and has a basis weight suitable for manufacturing an insulated container such as a paper cup, in which case the board preferably has a basis weight ranging from about 200 to about 220 lbs/3000 ft.$^2$ (3MSF). Low density paperboard according to the invention incorporates from about 0.25 to 10 wt. % (on a dry basis) expanded micropheres and has a relatively low apparent density ranging from about 6.0 to about 10 lb./3MSF/mil and a relatively high caliper ranging from about 24 to about 35 mil. These properties are especially well-suited for board products used to manufacture cups, particularly cups dimensioned to contain 16 ounces of fluid (Internal base diameter=2¼ inches). However, it is to be appreciated that low density paperboard according to the invention may find utility in a wide range of applications and product dimensions where properties of low density/thermal insulation are desirable.

In cup applications where the product is intended to contain a liquid, it is preferred to include on the surface of the board to contact the liquid a barrier coating suitable for blocking passage of liquid into the board. A low density polyethylene coating is preferred for this purpose.

For cups and containers intended for heated fluids, it is generally only necessary to coat the surface of the board to be used on the inside of the container, and for chilled fluids (i.e. iced or cold drinks) where outer condensation is an issue, to coat both surfaces.

For paperboard according to the invention within the aforementioned ranges of density and caliper destined for cup manufacture, it is preferred that the board also be formed so as to exhibit an average (i.e. average of MD and CD) internal bond strength of at least about $100\times10^{-3}$ ft-lbf. This minimum internal bond together with other board properties is believed necessary in order that the board may be successfully converted into cup shapes and similar articles without significant adverse effects caused by the converting operations. Among these adverse effects are so-called "buckles" which can appear along the height of a cup during the process of cup forming where polyethylene-coated board develops small ripple-like deformations as a blank is wrapped around a mandrel to form a cup wall.

Other factors believed to influence development of buckles during conversion operations include the method of applying the coating onto the board and the weight of the coating. Thus, for conventional extruded polyethylene coating conditions (speed and weight) the $100\times10^{-3}$ ft-lbf minimum average internal bond is believed necessary for proper conversion, while lowering the extrusion speed by 25 percent below the conventional speed or increasing the coat weight in the neighborhood of about 50 percent above the conventional weight will ordinarily allow a corresponding reduction in the minimum average internal bond to about $80\times10^{-3}$ ft-lbf.

According to one aspect of the invention, the uncoated low density board surface has a roughness substantially higher than conventional cupstock on the Sheffield smoothness scale which, quite surprisingly, results in comparable print quality in a flexo printing operation. Thus, for a typical low density board according to the invention suitable for cupmaking, the uncoated surface of the board exhibits a Sheffield smoothness of at least about 300 SU and a PPS10 smoothness at or below about 6.5 microns.

The low density board of the invention is contrasted with conventional cupstock which is calendered to provide, among other things, a much higher density in the order of 11–12 lb/3MSF/mil, a much lower caliper in the range of 20 mil, and an associated relatively smooth surface in the range of from about 160 to about 200 SU believed necessary for acceptable print quality. This higher density/lower caliper board has the effect of increasing the thermal conductivity of the board (i.e., decreased insulation).

In another aspect, the invention provides a method for making a low density paperboard material suitable for use in producing insulated containers such as cups. The method includes providing a papermaking furnish containing cellulosic fibers, and from about 0.25 to about 10% by weight dry basis expandable microspheres, preferably from about 5 to about 7 wt. %, forming a paperboard web from the papermaking furnish on a papermaking machine, and drying and calendering the web to an apparent density ranging from about 6.0 to about 10.0 lb/3MSF/mil, most preferably from about 6.5 to about 10.0 lb/3MSF/mil, and a caliper of from about 24 to about 35 mil, most preferably from about 28 to about 35 mil.

In yet another aspect, the invention provides a method for making an insulated container such as a paper cup from a paperboard material. The method includes providing a papermaking furnish containing cellulosic fibers and from about 0.25 to about 10 wt % dry basis expandable microspheres, preferably from about 5 to about 7% by weight, forming a paperboard web from the papermaking furnish on a paper machine, and drying and calendering the web to an apparent density ranging from about 6.0 to about 10.0 lb/3MSF/mil, preferably about 6.5 to about 10.0 lb/3MSF/mil, a caliper ranging from about 24 to about 35 mil, preferably from about 28 to about 35 mil, an internal bond of at least about $80\times10^{-3}$ ft-lbf, preferably at least about $100\times10^{-3}$ ft-lbf, and a Sheffield smoothness of at or above about 300 SU, and thereafter forming the web into a container such as a paper cup including the paperboard web at least for the sidewall portion of the cup.

Paperboard webs made according to the invention exhibit increased insulative properties compared to conventional single ply paperboard webs and are significantly less expensive to produce than multi-layered paperboard products or paperboard products containing a foamed outer coating. The low density paperboard material may therefore be converted into cups and other insulated containers on conventional processing equipment with minimal loss in machine speed, and a reduced tendency to form buckles and other irregularities in the converting operations.

A key feature of the invention is the use of expandable microspheres in the papermaking furnish and a resulting relatively low density/high caliper board containing the expanded spheres. Although the presence of microspheres in the papermaking furnish had been thought to adversely effect physical properties of the resulting materials for certain end use applications, it has now been found that by producing the materials according to the invention, the resulting board may be readily converted into containers such as insulated cups. Without desiring to be bound by theory, it is believed that suitable insulative paperboard products having strength properties required for cup converting operations may be produced by significantly increasing the caliper of the material and decreasing the density (compared to conventional board products) while maintaining a relatively high internal bond.

BRIEF DESCRIPTION OF THE DRAWINGS

The above and other aspects and advantages of the invention will become further apparent by reference to the following detailed description of preferred embodiments when considered in conjunction with the accompanying drawings in which.

DETAILED DESCRIPTION OF PREFERRED EMBODIMENTS

Figure 1:
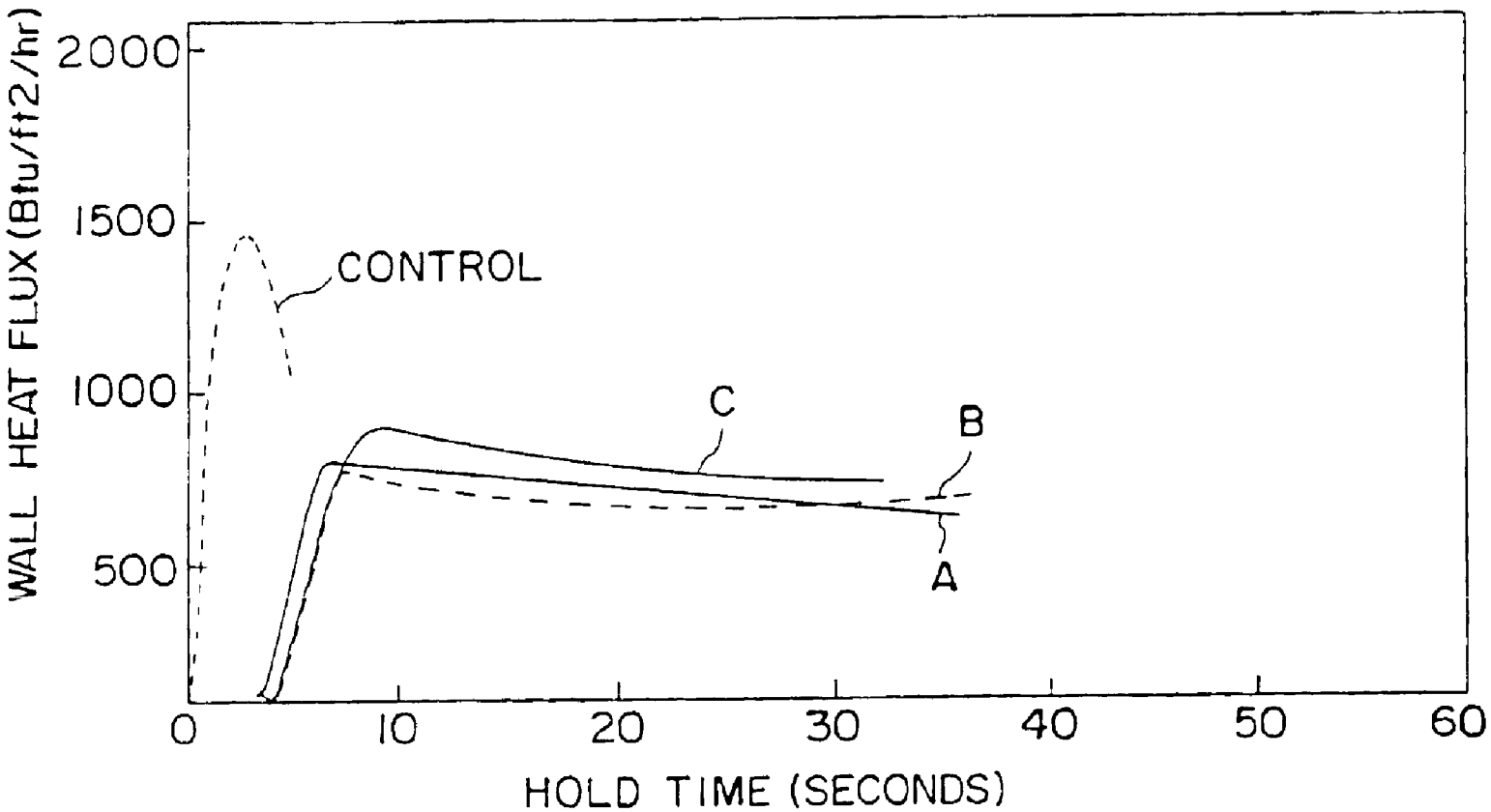
FIG. 1 which is a graphical representation of wall heat flux versus the amount of time a cup containing 190° F. water can be held.

Insulated containers such as cups are widely used for dispensing hot and cold beverages. Paperboard webs coated with an insulating layer often provide acceptable insulative properties, however, the outer layer is usually a foamed thermoplastic polymeric layer which raises the cost and is difficult to print. Corrugated and double-walled paperboard containers also generally provide suitable insulative properties, but are more complex and expensive to manufacture than single ply containers. Until now, it has been difficult to produce an economical insulated container made substantially of paperboard which has the required strength for convertibility, exhibits insulative properties, and contains a surface which is receptive to printing.

The invention provides an improved low density paperboard material having insulative properties suitable for hot and cold beverage containers, and which has the strength properties necessary for conversion to cups in a cup forming operation. The low density paperboard material is made by providing a papermaking furnish containing hardwood fibers, softwood fibers, or a combination of hardwood and softwood fibers. A preferred papermaking furnish contains from about 60 to about 80 percent by weight dry basis hardwood fiber and from about 20 to about 40 percent by weight dry basis softwood fiber.

Preferably, the fibers are from bleached hardwood and softwood kraft pulp. The furnish also contains from about 0.25 to about 10 percent by dry weight basis expandable microspheres, preferably in an unexpanded state. Most preferably, the microspheres comprise from about 5 to about 7 percent by weight of the furnish on a dry basis. Other conventional materials such as starch, fillers, sizing chemicals and strengthening polymers may also be included in the papermaking furnish. Among the fillers that may be used are organic and inorganic pigments such as, by the way of example only, polymeric particles such as polystyrene latexes and polymethylmethacrylate, and minerals such as calcium carbonate, kaolin, and talc.

The production of paper containing expandable microspheres is generally described, for example, in U.S. Pat. No. 3,556,934 to Meyer, the disclosure of which is incorporated by reference as if fully set forth herein. Suitable expandable microspheres include synthetic resinous particles having a generally spherical liquid-containing center. The resinous particles may be made from methyl methacrylate, methyl methacrylate, ortho-chlorostyrene, polyortho-chlorostyrene, polyvinylbenzyl chloride, acrylonitrile, vinylidene chloride, para-tert-butyl styrene, vinyl acetate, butyl acrylate, styrene, methacrylic acid, vinylbenzyl chloride and combinations of two or more of the foregoing. Preferred resinous particles comprise a polymer containing from about 65 to about 90 percent by weight vinylidene chloride, preferably from about 65 to about 75 percent by weight vinylidene chloride, and from about 35 to about 10 percent by weight acrylonitrile, preferably from about 25 to about 35 percent by weight acrylonitrile.

The center of the expandable microspheres may include a volatile fluid foaming agent which is preferably not a solvent for the polymer resin. A particularly preferred foaming agent is isobutane which may be present in an amount ranging from about 10 to about 25 percent by weight of the resinous particles. Upon heating to a temperature in the range of from about 80° to about 190° C. in the dryer unit of papermaking machine, the resinous particles expand to a diameter ranging from about 0.5 to about 50 microns.

Conventional pulp preparation (cooking, bleaching refining, and the like) and papermaking processes may be used to form paperboard webs from the furnish. However, one feature of the invention is that the low density web containing expanded microspheres is preferably produced in such a manner as to exhibit a minimum average internal bond (average of CD and MD internal bond) in conjunction with its decreased density and increased caliper in relation to conventional paperboard used to make insulative containers such as paper cups. To this end, those of ordinary skill are aware of various measures that alone or in combination may be taken to increase the internal bonding strength properties of paperboard webs for a given basis weight. These include, but are not limited to, increasing the addition of wet and/or dry strength agents such as melamine formaldehyde, polyamine-epichlorohydrine, and polyamide-epichlorohydrine for wet strength and dry strength agents such as starch, gums, and polyacrylamides for dry strength in the furnish, increasing the refining of the pulp, and increased pressing of the wet web in the press section of the papermachine. In addition to improving internal bond, increased wet pressing also reduces the moisture in the web and allows the paperboard to be dried at a faster speed than otherwise possible.

According to the invention, it is preferred that measures be taken sufficient to maintain a minium average internal bond of at least about $100\times10^{-3}$ ft-lbf. These measures are preferred, at least in regard to cupstock carrying a conventional weight of barrier coating applied in a conventional manner on one or both of its surfaces. However, the minimum internal bond strength may be relaxed somewhat for the heavier weight barrier coatings applied at the middle-upper end of the conventional 0.5 to 3.5 mil range of coating thicknesses. For example, at barrier coating thicknesses above about 1.5 mil a minimum internal bond of about $80\times10^{-3}$ ft-lbf is believed sufficient for acceptable converting performance. Also, reduction in the extrusion processing speed in the order of about 25 percent allows relaxation of the internal bond requirement to about the same minimum level.

Among the various approaches for increasing average internal bond, it is preferred to accomplish the desired increase by increasing the refining the pulp furnish, increasing the level of internal starch and dry strength additives, the wet pressing of the wet web during papermaking to a level below sheet crushing, and increasing the amount of starch and other materials applied to the surface of the paper web as is done, for example, at the sizepress.

The inclusion of expandable microspheres in the papermaking furnish in an unexpanded state has the effect of lowering the apparent density of the resulting dried board. However, it has been found that reducing the density of paperboard by inclusion of expanded microspheres adversely affects the convertibility of the board into cups and other containers. In accordance with the invention, it has been determined that low density paperboard products containing expanded micropheres produced in a relatively narrow range of densities and calipers in conjunction with the above-mentioned increased internal bond provides the physical properties necessary for processability in various converting operations. Such boards exhibit significantly improved insulation performance compared to conventional cupstock and double-walled containers and provide insulative properties comparable to containers having a foamed outer layer at a much lower cost. For example, low density board according to the invention has been observed to exhibit an R value in the neighborhood of 0.0752 $ft^2$-° F.-hrs/btu compared to an R value in the order of about 0.03 $ft^2$-° F.-hrs/btu for conventional cupstock, all the while exhibiting good convertibility properties, print quality, and other advantages.

Thus, in accordance with one embodiment of the invention, a paperboard web containing expandable microspheres is dried and calendared on the papermaking machine to an apparent density ranging from about 6.0 to about 10.0 lb/3MSF/mil and a caliper in the order of from about 24 to about 35 mil. As described above, the resulting web containing expanded microspheres interspersed among the fibers is preferably produced from a pulp and/or furnish treated in order to cause the web to exhibit an average internal bond of at least about $80\times10^{-3}$ ft-lbf for more heavily coated board (i.e., above about 1.5 mil up to the maximum of about 3.5 mil) and at least about $100\times10^{-3}$ ft-lbf for average for lightly coated board (i.e., from about 0.5 to 1.5 mil). Paperboard web containing expanded microspheres and having densities and calipers outside these ranges or, if within them, having an internal bond below about $80\times10^{-3}$ ft-lbf, is not believed to be suitable for use in forming commercially insulated cups. The upper bound for the caliper is selected to provide paperboard webs which may be converted into cups on existing cup-making equipment with only minor or no modifications to the machines.

In terms of other physical properties needed for cup manufacture, low density paperboard webs according to the invention also preferably have a minimum tensile strength as determined by Tappi Standard Test T of about 30 lbf/in, a minimum value for the average CD stretch of the substrate as determined by Tappi Standard Test T494 of about 3.3 percent.

It is an additional feature of the invention that the low density board has a roughness of at least about 300 on the Sheffield smoothness scale, while exhibiting comparable print quality in a flexo printing operation. The printability of the board is quite unexpected since conventional board such as cupstock is ordinarily calendered down to a caliper of about 20 mil in order to achieve a surface smoothness (uncoated) generally in the order of from about 125 to about 200 SU (from a pre-calendered smoothness in excess of 400 SU) believed necessary for acceptable print quality.

Thus, in calendering the board of the invention down to a caliper ranging from only about 24 to about 35 mil (preferably from about 28 to about 35 mil) and a density of from about 6.0 to about 10 lb/3MSF/mil (preferably from about 6.5 to about 10 lb/3MSF/mil) leaving a relatively rough surface having a Sheffield smoothness (uncoated) of about 300 SU or higher (ordinarily from about 320 to about 350 SU) and a PPS10 smoothness less than about 6.5 microns, a surprising bonus effect is observed in terms of printability over and above the insulation value and convertibility of the board for cup manufacture. Without being bound by theory, it is believed the printability of the board is attributable to its relatively high compressibility, which enables improved performance on flexo printing machines.

As mentioned previously, board made according to the invention is especially well-suited for making cups that require good thermal insulation properties. Such cups are ordinarily made with cupstock that includes a barrier coating on one or both sides. Cups designed for hot beverages such as coffees, soups, and other heated material generally require a coating only on the inside surface, so cupstock according to the invention for making these products may be barrier-coated only on one side, with the other side often carrying printing indicia/ designs applied directly to its surface. In the assembled cup, the coated side is arranged interiorly.

Cups designed for cold beverages are ordinarily made from cupstock coated on both sides and any printing is applied to one of the coating layers. Accordingly, cupstock according to the invention for making these products may be barrier-coated on both sides, with the non-printed side arranged interiorly. In cups carrying chilled beverages, the exterior barrier coating helps prevent any condensation forming on the outside from penetrating and possibly weakening the board substrate.

Any suitable barrier coating may be used to complete the product for conversion into a thermally insulated container such as a cup. Although low density polyethylene coatings are used for many such products and are preferred for use in the invention, natural and synthetic chemical systems such as starch-based coatings and polyvinyl alcohol-based coatings may also be used as well as pigmented coatings containing inorganic or organic pigments such as clay, carbonate, and latexes, so long as they provide sufficient barrier or other properties for the intended application. The coating(s) may be applied by conventional means, and in the case of polyethylene may be applied to the low density board surface by an extrusion lamination or by laminating a pre-formed film. The thickness of the coating may generally range from about 0.5 to about 3.5 mil, and is preferably about 1.5 mil on the inside surface of the container or cup and about 1 mil when used on the outside surface.

As a specific and especially preferred low density board product according to the invention, a low density paperboard material comprises a paperboard web which includes expanded microspheres and has an apparent density of 7.0 lbs/3000 $ft^2$/mil, a caliper of 28 mil, Sheffield smoothness of at least 300 SU, PPS10 smoothness of 6.5 microns or less, tensile strength (cross direction) of 30 lbf/in, and an internal bond (cross-direction) of $90\times10^{-3}$ ft/lbf/mil. This board has a basis weight of 200 lb/3000 $ft^2$ and the microspheres constitute 5 to 6 wt. % dry basis of the web. A low density polyethylene is extrusion laminated to one or both sides of the web in a thickness of about 1.5 mil. The resulting low density paperboard material is convertible into cups without significant problems and exhibits and R value in the order of 0.07 $f^2$-° F-hrs/btu.

Again, it is to be appreciated that low density board according to the invention may be used to make a range of potential products including, but not limited to, cups and other paperboard containers formed to hold warm, hot, or cold material where there is a need for insulation and at least short-term barrier properties. Also, when used to make cups (a primary intended application), the bottom section is normally a flat separate piece and may or may not be formed from low density insulated board made according to the invention, depending on economics and other factors.

Also, in forming cups it is a commercial reality that some conventional packaging machinery is designed to accommodate the use of only a narrow range of board calipers. Because insulated board according to the invention may be thicker than standard cupstock (for a given basis weight), the increased caliper may cause manufacturing issues potentially requiring new or modified tooling. The present invention may to used to advantage in these situations by exposing a portion of the paperboard (generally after having been cut to form a blank) to relatively high pressures (approximately 200 psi or greater), which will permanently compress the portion of the board allowing it to be used in conventional tooling.

An example is the sideseam of a package or cup. At a given basis weight the insulated board of the invention may have a significantly higher caliper than a standard board, creating a sideseam which may be too thick for some conventional converting applications. By exposing the side seam portion of the blank or the formed carton to high pressures, the thickness may be reduced to at or near conventional board caliper levels (generally about 20 mil). This processing step is generally referred to in the art as "crimping" and may be considered a pretreatment of the finished low density board (i.e., board that has been coated) to facilitate its use in forming cups and other paperboard containers having one or more lap seams.

The same sort of crimping operation may be performed on the portion of the blank to be used to make the rim of a cup or tub type of container to reduce the final rim thickness. This has the advantage of improving aesthetic appearances with a smaller diameter rim or allowing use of existing lids on a cup or tub container made of insulated board. The rim consists of an edge of the package being rolled into a cylinder. This is typically a 360 degree wrap of the board.

It is also to be noted that the minimum rim cylinder diameter is typically a function of the board thickness. Thus, for a conventional cup manufacturing process the rim diameter (the diameter of the cylinder form taken by the rolled-over part of the blank that forms the rim encircling and forming the top edge) is ordinarily about 7 times the board caliper. If the top portion of the rim is crimped to reduce the caliper, the diameter of rim cylinder may also be reduced. The portion of the blank that will form the rim may be crimped to reduce its entire diameter, or it may be crimped with a series of parallel scopes which will aid deformation.

The same crimping technology may be applied to sideseams after they are formed to reduce their overall thickness.

Further aspects, advantages and features of the invention may be seen by way of the following non-limiting examples. In these examples, the paperboard with a LDPE coating was used to form the sidewall blank for the cups on a cup-making machine, the cups having a sidewall seam. In the tables, the basis weight is of the paperboard itself without the polyethylene coating, which ordinarily adds in the neighborhood of about an additional 5 to 20 percent to the overall weight of the paperboard when, for example, LDPE material is extrusion laminated to one surface of the board at about 1.5 mil thickness.

EXAMPLE 1

In the following example, samples of low density board containing microspheres were produced and compared to a sample marked "control" which contained no microspheres. Expandable microspheres used in the furnish are available from Expancel, Inc. of Duluth, Ga. of under the trade name EXPANCEL. The targeted caliper for the samples was 19 mil to simulate conventional cupstock calipers. After producing the boards, they were taken off-machine to an extruder and extrusion coated with low density polyethylene at a rate of 14 lbs/3MSF to provide a barrier coating on one side having a thickness of about 1 mil. All of the samples except Sample D contained the polyethylene coating. Sample D had insufficient strength and was too brittle to be extrusion coated with polyethylene. The polyethylene-coated samples were converted to 16 oz. cups on a commercial cup machine. The insulative properties of the cups were determined by measuring the time a person could hold a cup filled with hot water having a temperature of 190° F. Relevant properties of the low density board samples are given in Table 1.

TABLE 1

| Properties | Control | Sample A | Sample D | Sample E | Sample G | Sample M |
|---|---|---|---|---|---|---|
| EXPANCEL microspheres (lb/ton) | 0 | 60 | 240 | 603 | 100 | 100 |
| Dry Strength additive (lb/ton)[1] | 0 | 0 | 0 | 40 | 40 | 40 |
| Basis weight (lb/3MSF) | 216 | 173 | 196 | 179 | 140 | 139 |
| Caliper (mil) | 21.0 | 18.4 | 85.0 | 22.4 | 19.0 | 21.0 |
| Density (lb/3MSF dry basis) | 10.3 | 9.4 | 2.3 | 8.0 | 7.4 | 6.6 |
| Stretch at Peak (%), MD | 1.93 | 2.41 | 2.23 | 1.74 | 2.01 | 1.76 |
| Stretch at Peak (%), CD | 4.03 | 4.83 | 4.52 | 4.40 | 4.73 | 4.79 |
| Tensile Strength (lbf/in), MD | 72.0 | 68.5 | 27.7 | 52.3 | 45.5 | 38.2 |
| Tensile Strength (lbf/in), CD | 46.5 | 39.2 | 17.5 | 33.1 | 26.2 | 23.0 |
| Wet Tensile Strength (lbf/in), MD | 4.03 | 3.28 | 3.05 | 3.96 | 2.87 | 2.64 |
| Wet Tensile Strength (lbf/in), CD | 2.69 | 2.06 | 1.81 | 2.14 | 1.51 | 1.58 |
| Internal Bond ($1*E^{-3}$ ft-lbf), MD | 68 | 94 | 48 | 77 | 90 | 96 |
| Internal Bond ($1*E^{-3}$ ft-lbf), CD | 72 | 83 | 50 | 78 | 79 | 86 |
| Internal Bond ($1*E^{-3}$ ft-lbf), AVG | 70.0 | 88.5 | 49.0 | 77.5 | 84.5 | 91.0 |
| Sheffield Smoothness (SU), FS | 285 | 275 | 478 | 300 | 311 | 327 |
| Sheffield Smoothness (SU), WS | 296 | 277 | 478 | 310 | 312 | 328 |
| Cobb ($g/m^2$), FS | 31.0 | 31.0 | 14.7 | 23.0 | 21.1 | 22.0 |
| Cobb ($g/m^2$), WS | 53.0 | 25.7 | 14.7 | 23.0 | 22.0 | 20.3 |
| Taber Stiffness (gf-cm), MD | 203 | 119 | 704 | 168 | 104 | 115 |
| Taber Stiffness (gf-cm), CD | 111 | 66.4 | 443 | 88.3 | 42.6 | 48.3 |
| Tear strength (gf), MD | 456 | 430 | 387 | 499 | 304 | 326 |
| Tear strength (gf) | 448 | 491 | 518 | 496 | 370 | 320 |
| Sheffield Permeance (units/in.$^2$) | 247 | 436 | 3580 | 688 | 1190 | 1240 |

[1]The dry strength additive was an anionic polyacrylamide sold under the trade designation ACCOSTRENGTH available from BAYER of Leverkusen, Germany.

Of the foregoing samples, Sample G exhibited notably good insulative properties. The average time a person could hold a cup made from sample G was 29 seconds compared to 11 second for the control sample. While Sample G had excellent insulative properties, the lower basis weight of the board resulted in lower stiffness and consequently a cup made with the board had lower rigidity. Rigidity is an essential attribute for cups, accordingly it was necessary to improve the stiffness of the cupstock. Sample M having a density of 6.6 lbf/3MSF/mil and an average internal bond strength of $91\times10^{-3}$ ft-lbf could be processed on an extrusion line and converted to cups. The stiffness of the board was somewhat improved over the stiffness of Sample G. Sample M also had better insulative performance than the control sample, the latter having a density of 10.3 lb/3MSF/mil.

The internal bond of sample M was somewhat below the preferred internal bond of at least about $100\times10^{-3}$ lb/3MSF/mil, but still was able to be converted. However, as mentioned earlier this somewhat lower internal bond may be deemed acceptable when extruder speed is reduced and/or the weight of the barrier coating is increased.

The density of Sample D was too low for web handling processes. The density of Sample D was 2.3 lb/3MSF/mil and the average internal bond strength was $49\times10^{-3}$ ft-lbf. This bond strength was found to be too low for the web to be processed in an extrusion coater or to be used in a cup forming operation.

The apparent thermal conductivity of the low density boards was measured by the Guarded Heat Flow Method (ASTM C177). The results showed an essentially linear relationship between density and conductivity with the higher density boards exhibiting higher conductivity (i.e., lower thermal insulation). Graphing the data, it was determined that the relationship between conductivity and density for the boards tested may be expressed by the following equation:

$$\text{Thermal Conductivity } (ft^2\text{-}^\circ\text{ F.-hrs/btu}) = 0.494\times\text{Density } (\text{lb/3MSF/mil}) + 0.313\ (ft^2\text{-}^\circ\text{ F.-hrs/btu})$$

EXAMPLE 2

In the following example, two different low density board stocks were made having densities in the range of from about 6 to about 10 lb/3MSF/mil and from furnish containing expandable microspheres. The board stock thus made was converted to 16 oz. cups. The physical properties of the board stock are shown in Table 2. All of the samples in Table 2 were coated with low density polyethylene on an extrusion line and printed on an aqueous flexo press. The coating was applied to one side of the board at about 20 mil and the printing was applied to the other side.

The coated board indicated as Sample 19 was converted to cups on a commercial machine with existing tooling. The board indicated as Sample 32 was converted to cups using prototype tooling on a commercial cup machine. The rims of the cups formed using the prototype tooling were only partially formed. Modification of the tooling will enable completely formed cups.

TABLE 2

| Properties | Control | Sample 27 | Sample 19 | Sample 32 |
|---|---|---|---|---|
| Softwood fiber (wt. %) | 30 | 30 | 30 | 30 |
| Hardwood fiber (wt. %) | 70 | 70 | 70 | 70 |
| Wet end Starch (lb/ton) | 10 | 10 | 10 | 10 |
| ACCOSTRENGTH (lb/ton) | 6.8 | 6.8 | 6.8 | 6.8 |
| EXPANCEL microsphere dosage (lb/ton) | 0 | 106 | 114 | 120 |
| Refiner (HPDT/ton) | 3.8 | 4.1 | 4.1 | 4.1 |
| Basis weight (lb/3MSF dry basis) | 218.7 | 235.9 | 143.2 | 211.4 |
| Caliper (mil) | 18.71 | 26.97 | 18.21 | 30.22 |
| Density (lb/3MSF/mil) | 11.69 | 8.75 | 7.86 | 6.99 |

TABLE 2-continued

| Properties | Control | Sample 27 | Sample 19 | Sample 32 |
|---|---|---|---|---|
| Internal Bond (1.e$^{-3}$ ft-lbf), MD | 112 | 141 | 88 | 98 |
| Internal Bond (1.e$^{-3}$ ft-lbf), CD | 113 | 124 | 88 | 107 |
| Taber Stiffness (gf-cm), MD | 240 | 370 | 139 | 366 |
| Taber Stiffness (gf-cm), CD | 31 | — | 30 | — |
| Instron Stretch at Peak, %, MD | 1.79 | 1.49 | 1.74 | 1.36 |
| Instron Stretch at Peak, %, CD | 4.31 | 4.79 | 5.77 | 4.59 |
| Instron Tensile Strength, (lbf/in), MD | 98.9 | 72.1 | 55.5 | 56.6 |
| Instron Tensile Strength, (lbf/in), CD | 49.9 | 39.8 | 32.1 | 32.1 |
| Instron Young's MOE, 1E+3 (lbf/in$^2$), MD | 596 | 321 | 348 | 225 |
| Instron Young's MOE, 1E+3 (lbf/in$^2$), CD | 302 | 126 | 139 | 83.1 |
| Roughness (Sheffield Units), FS | 324 | 297 | 297 | 305 |
| Roughness (Sheffield Units), WS | 328 | 353 | 324 | 333 |
| Brightness, Directional (GE, %), FS | 78.9 | 80.5 | 81.8 | 81.9 |
| Brightness, Directional (GE, %), WS | 78.6 | 79.9 | 82.1 | 81.1 |
| Air Permeance (Sheffield) (units/in$^2$) | 319 | 377 | 858 | 851 |
| Air Resistance (Gurley, s/100cc) | 26.5 | 21.0 | 8.4 | 8.8 |

Of the foregoing samples, Sample 32 exhibited notably good insulative properties. The average time a person could hold a cup made from Sample 32 was 37 seconds compared to 11 second for the control sample. Furthermore, the relatively high stiffness of the board of Sample 32 as indicated in the table resulted in suitable rigidity compared to standard board. The stiffness of Sample 32 was significantly greater than the stiffness of any of the samples of Example 1.

The insulative properties of a cup made from paperboard cup stock was determined by measuring the sidewall temperature of a cup containing a hot liquid. A maximum value of sidewall temperature for a cup containing a hot liquid is typically specified for an insulated cup. The sensory perception of heat is dictated by skin tissue exposed to the hot cup sidewalls for a period of time. Tissue temperature is a function of the heat flow to the tissue from the cup and the internal heat dissipation within the tissue. The heat flow to the tissue is a combination of several factors including the thermal properties of the board, the temperature of the liquid, and the contact resistance between the tissue and the outer wall of the cup. The cup rigidity and surface roughness (i.e. texture) is also believed to contribute to the sensory perception of heat by influencing the effective contact area between the cup sidewalls and the tissue.

FIG. 1 is a graphical representation of the wall heat flux over time for the cups containing 190° F. water. The data shown in FIG. 1 was collected by applying pressure on the flux sensor. In the figure, Curve A is a cup made with Sample 32 (Table 2), Curve B is a cup made according to U.S. Pat. No. 4,435,344 to Iioka containing an outer insulating layer, Curve C is a conventional double-walled cup, and the Control curve is a conventional single-walled non-insulated cup.

It is believed the data for FIG. 1 represents a relatively accurate measurement of heat flowing to tissue for cups being held under normal holding pressure. At the point excessive heat was perceived, data collection was terminated.

As shown by the curves of FIG. 1, a cup made with the paperboard of Sample 32 (Curve A) exhibited comparable thermal insulative properties to cups made according to U.S. Pat. No. 4,435,344 to Iioka (Curve B). In this regard, it is noted that the Curve B cups were produced by coating the outer wall of a cup with a thermoplastic resin which is subsequently foamed. However, the process for producing the Curve B cups requires additional capital equipment for the conversion and the thermoplastic coating adversely affects print quality and the hand-feel of the cups. In contrast, cups made using the paperboard stock of Sample 32 had no external thermoplastic coating (the coating was only on the interior surface) and an appearance and feel similar to that of conventional paper cups. The Sample 32 cups also exhibited better thermal insulative properties than the conventional double-walled cup of Curve C.

EXAMPLE 3

In the following example, eight low density board stocks were made having densities in the range of from about 6 to about 10 lb/3MSF/mil and from furnish containing expandable microspheres. The board stock thus made was converted to 16 oz. cups. The physical properties of the board stock are shown in Table 3. All of the samples in Table 3 were coated with low density polyethylene on an extrusion line and printed on an aqueous flexographic press. The coating was applied to one side of the board at about 1.5 mil and the printing was applied to the other side directly on the paper surface.

Samples P1 and P2 were manufactured on a pilot papermachine and extruded on a pilot extruder whereas samples C1 through to C5 were manufactured on a commercial papermachine. In both cases, the papermaking furnish used to produced these samples contained a blend of hardwood and softwood pulps and wet-end chemicals, such as starch and dry strength additives, and a suitable amount of expandable microspheres to achieve a range of board densities. In each case, the refining energies and level of wet-end chemical addition was varied to achieve a range of internal bond strengths. Following polyethylene extrusion and conversion into cups, the samples were inspected and rated for the degree of MD buckling or wrinkles, which are a measure of the converting potential of the coated board. Samples with a severe degree of buckling would be unsuitable as a commercial product.

TABLE 3

| ID | Sample P1 | Sample P2 | Sample C1 | Sample C2 | Sample C3 | Sample C4 | Sample C5 |
|---|---|---|---|---|---|---|---|
| MD Buckling | Severe | None | Severe | Medium | None | None | None |
| Caliper, mil | 32.9 | 33.3 | 31.5 | 28.5 | 30.2 | 27.0 | 28.6 |
| Basis Weight (lb/3MSF) | 187 | 331 | 202 | 196 | 211 | 236 | 232 |
| Weight Percent of EXPANCEL, (%) | 6.0 | 2.0 | 6.0 | 6.0 | 6.0 | 3.0 | 4.0 |

TABLE 3-continued

| ID | Sample P1 | Sample P2 | Sample C1 | Sample C2 | Sample C3 | Sample C4 | Sample C5 |
|---|---|---|---|---|---|---|---|
| Apparent Density, (lb/3MSF/mil) | 5.68 | 9.91 | 6.40 | 6.89 | 6.98 | 8.75 | 8.11 |
| Internal Bond, (1E-3 ft*$lb_f$), MD | 74 | 147 | 75 | 83 | 99 | 131 | 98 |
| Internal Bond, (1E-3 ft*$lb_f$), CD | 72 | 151 | 75 | 81 | 103 | 134 | 101 |
| Sheffield Smoothness (SU), FS | 352 | 297 | 313 | 304 | 333 | 297 | 294 |
| Sheffield Smoothness (SU), WS | 372 | 336 | 308 | 284 | 305 | 353 | 286 |
| Taber Stiffness ($g_f$*cm), MD | 377 | 637 | 355 | 358 | 366 | 370 | 436 |
| Taber Stiffness ($g_f$*cm), CD | 128 | 400 | 136 | 125 | 129 | 146 | 163 |

Samples P1 and C1 illustrate the condition wherein the internal bond strength is below the minimum of $80\times10^{-3}$ lb/3MSF/mil. For these conditions, the samples showed severe MD buckling, indicating that they would not be suitable as a commercial product. Sample P2 illustrates the case where the density of the board is significantly lower than normal paperboard used in the production of cups but because of its high internal bond strength the product does not exhibit MD buckling. Sample C2 shows some degree of buckling because its internal bond strength of $81\times10^{31\ 3}$ lb/3MSF/mil is at the lower limit of the preferred range of internal bond strength. Samples C3, C4, and C5 illustrate the preferred levels of density and internal bond strength.

Samples P1 and C1 illustrate the condition wherein the polyethylene has a caliper of about 1.5 mil and the internal bond strength is below the minimum of $80\times10^{-3}$ lb/3MSF/mil. For these conditions, the samples showed severe MD buckling, indicating that they would not be suitable as a commercial product. Sample P2 illustrates the case where the density of the board is significantly lower than normal paperboard used in the production of cups but because of its high internal bond strength the product does not exhibit MD buckling. Sample C2 shows some degree of buckling because its internal bond strength of $81\times10^{-3}$ lb/3MSF/mil is at the lower limit of the preferred range of internal bond strength. Samples C3, C4, and C5 illustrate the preferred levels of density and internal bond strength. Sample C6 illustrates how an increase polyethylene coat weight in the order of about 20 percent can compensate for the low internal bond strength.

The foregoing examples demonstrate that within the apparent density range of about from about 6 to about 10 lb/3MSF/mil and calipers ranging from about 24 to about 35 in conjunction with a relatively high internal bond above at least about 80 ft-lbf the physical properties of the low density board are suitable to enable processing of cupstock to make insulated cups.

Cups are typically shipped in sleeves of 50. In order to prevent the cups from interlocking in the sleeve, the cup is ordinarily designed so that the outer bottom edge of one cup rests on the inner bottom of the cup below it. This requirement along with the desired interior volume of the cup and the aesthetic needs of the cup place additional constraints on the allowable board thickness. For example, it is preferable that the caliper of the basestock for 16 ounce cups not exceed about 35 mil. Accordingly, the upper limit of caliper for a 16 ounce cup is preferably about 32 mil.

In the web forming process, webs containing the expandable microspheres were preferably pressed to a higher solids content than webs which do not contain the microspheres.

Once the web is pressed and dried it is calendared to a thickness which provides the desired density/caliper within the ranges set forth for low density board according to the invention. The calendaring machine may be a conventional multi-roll calender, but is preferably a heated extended nip, long nip, or shoe nip calendaring machine which provides an improved microsmoothness at an extended dwell time and reduced pressure. Accordingly, the calendaring machine may contain one or more extended nips having a dwell time in the range of from about 2 to about 10 microseconds and a peak nip pressure of less than about 1200 psi.

Figure 3:
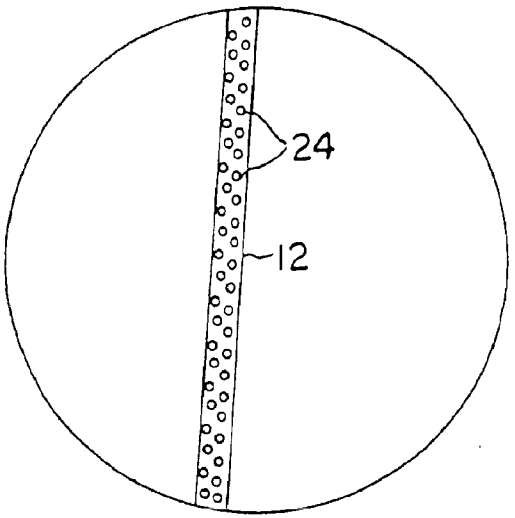
FIG. 3 is a cross-sectional view of a wall portion of a paperboard cup made according to the invention.
Figure 2:
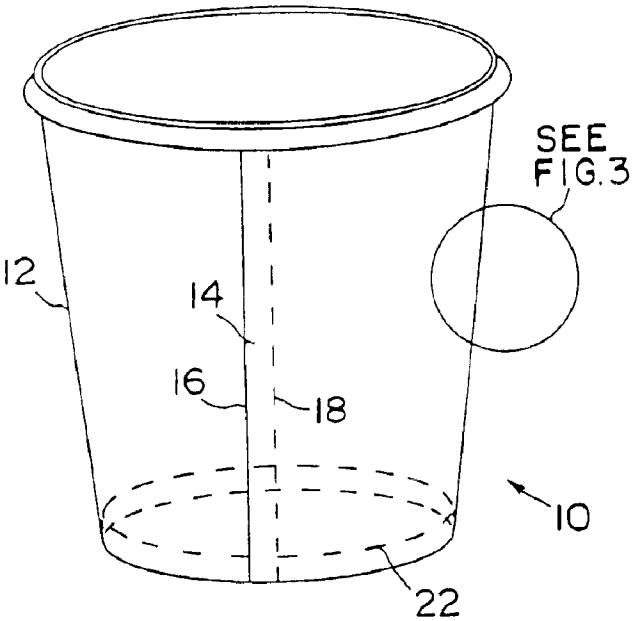
FIG. 2 is a diagrammatic view in perspective of an insulated paperboard cup made according to the invention.
Figure 5:
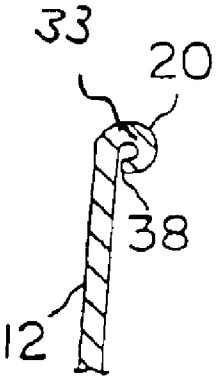
FIG. 5 is a cross-sectional view of a top rim wall portion of a cup according to the invention.
Figure 4:
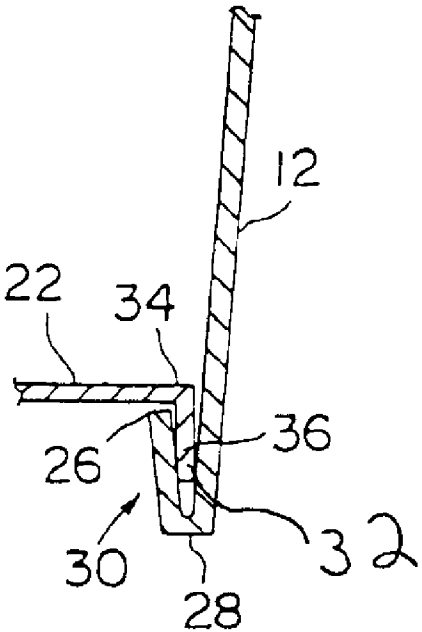
FIG. 4 is a cross-sectional view of a connection between a bottom portion and a side wall portion of a cup according to the invention.

With reference to FIGS. 2–5, one embodiment of a cup 10 made with the low density insulated paperboard material of the invention is illustrated in the form of an inverted truncated cone. The cup 10 includes a generally cylindrical wall portion 12 having a vertical lap seam 14 joining the end edges 16 and 18 of a paperboard web forming the wall portion 12. The end edges 16 and 18 may be affixed to one another using conventional methods such as adhesives, melt-bonding thermoplastic coatings thereon or other means known in the art. The cup 10 also includes a circular, rolled rim 20 and a separate substantially circular bottom portion 22 which is attached and sealed to the wall portion 12 along the periphery thereof. FIG. 4 described below illustrates a method for attaching the bottom portion 22 to the wall portion 12 and FIG. 5 illustrates a rolled rim 20 of a cup according to the invention.

As seen in FIG. 3, the wall portion 12 of the cup 10 is made from a low density insulated paperboard material according to the invention which contains expanded microspheres 24 dispersed within the fibrous matrix of the paperboard. The microspheres 24 are preferably substantially hollow and provide insulative properties to the wall and bottom portions 12, 22 of the cup 10. However, bottom 22 may be a conventional coated board material in order to improve the economics of the product, since heating of the bottom is not generally an issue as the cup is not typically held by a user on the bottom.

Because of the increased caliper of the paperboard material used to form the wall and bottom portions 12, 22 of the cup 10, modifications to the converting equipment and/or the board itself may be necessary to achieve the folds and rolls required for assembling the cup portions together. Pretreatment measures of modifying the caliper of portions of the board (i.e. "crimping") have already been described above in order to facilitate conversion/assembly of the cups.

As seen in FIG. 4, the bottom end 26 of the wall portion 12 is folded along fold seam 28 to provide a generally V-shaped pocket 30. End 32 of the bottom portion is folded along seam 34 to provide a substantially right angle flap 36 (which may be crimped in a pretreatment step) received in the pocket 30. The flap 36 may be sealed in the pocket 30 in a similar manner to the formation of seam 14 described above.

Circular top end 38 of wall portion 12 (which may be crimped in pretreatment step) is preferably rolled as shown in FIG. 5 to provide a circular, rolled rim 20. Tooling required to form rolled rim 20 may also need to be modified because of the increased caliper of the paperboard material used to make wall portion 12, especially if top end area 33 used to make the rim 20 is not crimped or compressed in a pretreatment step. Rolled rim 20 provides reinforcement to the upper portion of the cup in order to maintain a substantially open cup for retaining liquids, to limit dripping, and to provide a more comfortable edge from which to drink.

It will again be appreciated that the interior and, optionally, the exterior of the cup 10, may contain conventional barrier coatings to reduce the porosity of the cup so that liquids will not soak into the paperboard substrate of the wall and bottom portions 12, 22. The coatings may be one or more layers of polymeric materials such as polyethylene (preferably low density), EVOH, polyethylene terephthalate, and the like which are conventionally used for such applications.

The foregoing description of certain exemplary embodiments of the present invention has been provided for purposes of illustration only, and it is understood that numerous modifications or alterations may be made in and to the illustrated embodiments without departing from the spirit and scope of the invention.

What is claimed is:

1. An assembled paper container which comprises a sidewall and a bottom sealably joined together wherein the sidewall is provided by a paperboard material which comprises a paperboard web including wood fiber and from about 5 to about 10 wt. % dry basis expanded synthetic polymer microspheres based on the total weight of the web dispersed within the fibers, an apparent density of from about 6.0 to about 10 lb/3MSF/mil, a caliper of from about 24 to about 35 mil, an average internal bond of at least about $80\times10^{-3}$ ft-lbf, a Sheffield smoothness of about 300 SU or greater, and a barrier coating having a thickness of from about 0.5 to about 3.5 mil disposed adjacent at least one surface of the web.

2. An assembled paper cup which comprises a sidewall and a bottom sealably joined together wherein the sidewall is provided by a paperboard material which comprises a paperboard web including wood fiber and from about 5 to about 10 wt. % dry basis expanded synthetic polymer microspheres based on the total weight of the web dispersed within the fibers, an apparent density of from about 6.0 to about 10 lb/3MSF/mil, a caliper of from about 24 to about 35 mil, an average internal bond of at least about $80\times10^{-3}$ ft-lbf, a Sheffield smoothness of about 300 SU or greater, and a barrier coating having a thickness of from about 0.5 to about 3.5 mil disposed adjacent at least one surface of the web.

* * * * *